US011493033B2

(12) United States Patent
Jindra et al.

(10) Patent No.: US 11,493,033 B2
(45) Date of Patent: Nov. 8, 2022

(54) LOW ENERGY IDLING FOR A COMPRESSED AIR SYSTEM

(71) Applicant: CLARK EQUIPMENT COMPANY, Statesville, NC (US)

(72) Inventors: Petr Jindra, Dobris (CZ); Ctibor Balas, Dobris (CZ); Jaromir Nusl, Dobris (CZ)

(73) Assignee: CLARK EQUIPMENT COMPANY, Statesville, NC (US)

( * ) Notice: Subject to any disclaimer, the term of this patent is extended or adjusted under 35 U.S.C. 154(b) by 355 days.

(21) Appl. No.: 16/197,038

(22) Filed: Nov. 20, 2018

(65) Prior Publication Data

US 2020/0158103 A1 May 21, 2020

(51) Int. Cl.

| | |
|---|---|
| ***F04B 49/02*** | (2006.01) |
| ***F04B 49/20*** | (2006.01) |
| ***F04D 27/00*** | (2006.01) |

(52) U.S. Cl.

CPC ..... *F04B 49/02* (2013.01); *F04B 49/20* (2013.01); *F04D 27/009* (2013.01); *F04B 2201/06* (2013.01); *F04B 2203/0605* (2013.01); *F04B 2205/05* (2013.01); *F04B 2205/061* (2013.01); *F04B 2205/16* (2013.01); *F04B 2207/043* (2013.01); *F04B 2207/0442* (2013.01)

(58) Field of Classification Search

None

See application file for complete search history.

(56) References Cited

U.S. PATENT DOCUMENTS

| | | | | |
|---|---|---|---|---|
| 3,961,862 | A * | 6/1976 | Edstrom | F04B 49/10 417/282 |
| 5,806,304 | A | 9/1998 | Price et al. | |
| 7,607,899 | B2 * | 10/2009 | Van Praag | F04B 49/225 417/440 |
| 2009/0218173 | A1 * | 9/2009 | Beeson | B66F 11/046 187/234 |
| 2010/0166571 | A1 * | 7/2010 | Van Den Wyngaert | F04C 18/16 417/44.2 |

(Continued)

FOREIGN PATENT DOCUMENTS

WO 2018/078491 A1 5/2018

OTHER PUBLICATIONS

International Search Report and Written Opinion dated Jan. 20, 2020 for related International Application No. PCT/2019/057550 (15 pages).

(Continued)

*Primary Examiner* — Essama Omgba
*Assistant Examiner* — Geoffrey S Lee
(74) *Attorney, Agent, or Firm* — Michael Best & Friedrich LLP

(57) ABSTRACT

An air compressor system includes a motor operably connected to an air compressor, a separator tank fluidly connected to the air compressor by a supply line, a compressed air line coupled to the separator tank, a service valve connected to the compressed air line and positioned downstream of the separator tank, and a controller in operable communication with the motor, wherein in response to the controller detecting the motor operating at an idle speed, the controller reduces the motor speed to a low idle speed and reduces pressure in the separator tank, the low idle speed being slower than the idle speed.

17 Claims, 6 Drawing Sheets

(56) References Cited

U.S. PATENT DOCUMENTS

| | | | | |
|---|---|---|---|---|
| 2012/0138582 | A1 | 6/2012 | Radtke et al. | |
| 2018/0223847 | A1 | 8/2018 | Fujiwara | |
| 2020/0072220 | A1* | 3/2020 | Moens | G05D 23/1951 |

OTHER PUBLICATIONS

International Preliminary Report on Patentability dated May 25, 2021 for corresponding International Application No. PCT/US2019/057550 (8 pages).

* cited by examiner

LOW ENERGY IDLING FOR A COMPRESSED AIR SYSTEM

FIELD OF THE DISCLOSURE

The present disclosure relates to a compressed air system. More specifically, the disclosure relates to a control system for a compressed air system that initiates a low energy consumption idling configuration in response to detection of idling of the compressed air system.

SUMMARY

In one embodiment, the invention provides an air compressor system that includes a motor operably connected to an air compressor, a separator tank fluidly connected to the air compressor by a supply line, a compressed air line coupled to the separator tank, a service valve connected to the compressed air line and positioned downstream of the separator tank, and a controller in operable communication with the motor. In response to the controller detecting the motor operating at an idle speed, the controller reduces the motor speed to a low idle speed, the low idle speed being slower than the idle speed. In addition, the controller releases air pressure from the separator tank to a preset low idle pressure, the low idle pressure being lower than a system pressure while the motor operates at an idle speed.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

The present invention provides a control system 200 for a compressed air system 100. The control system 200 is configured to implement a low energy consumption operational configuration, also referred to herein as Eco-Mode, in response to detection of idling of the compressed air system 100. The low energy consumption operational configuration advantageously reduces energy consumption during periods of system nonuse (e.g., a period of non-use of compressed air, etc.). In addition, the control system 200 can include detection of incorrect usage of Eco-Mode, which can lead to undesirable hunting (or repeated acceleration and deceleration) of the compressed air system 100. The control system 200 can also include a demand air aspect, where in response to use of compressed air and/or an operator entered command, the control system 200 transitions from the low energy consumption operational configuration (or Eco-Mode) to a standard operational configuration.

Figure 1:
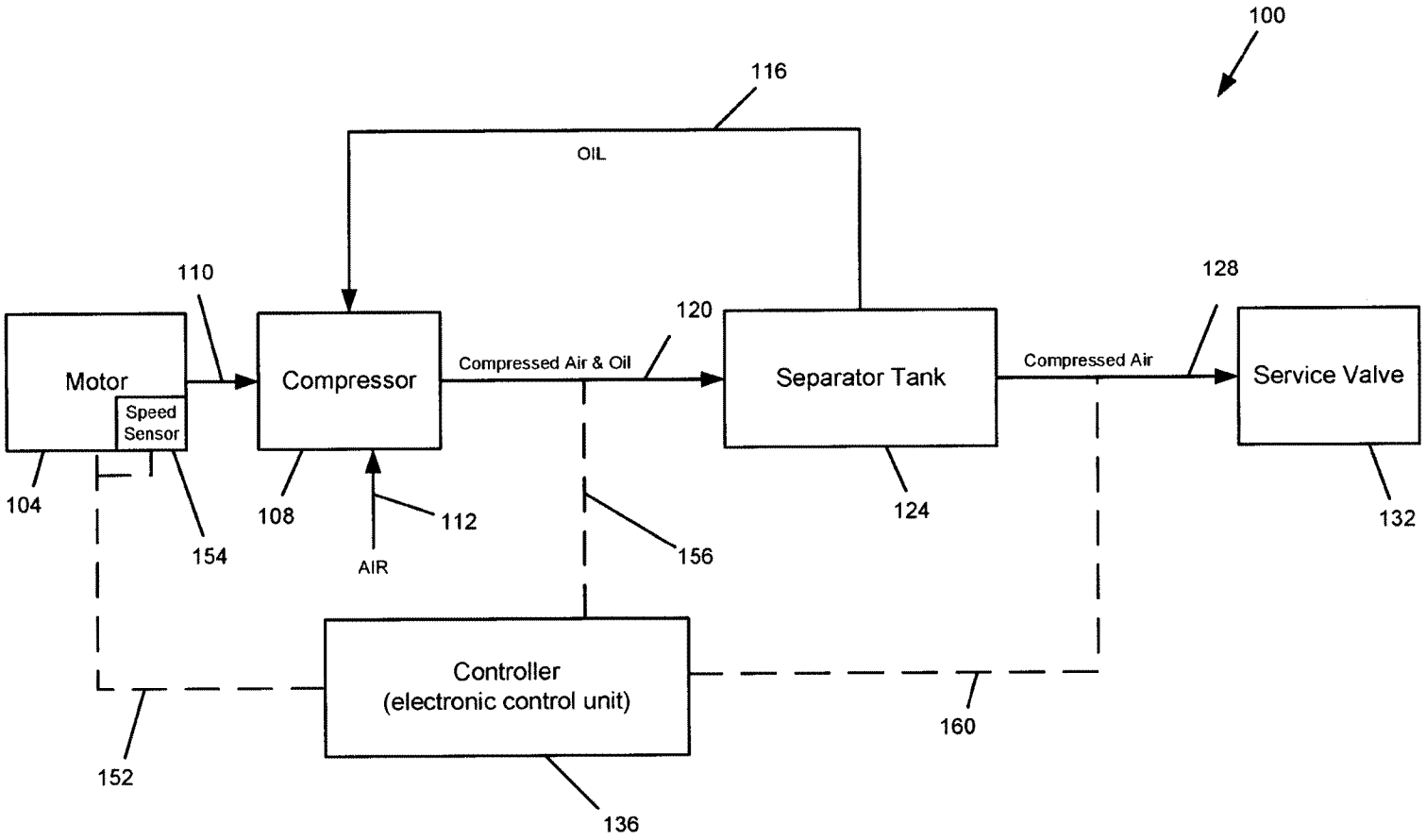
FIG. 1 is a schematic view of an embodiment of an air compressor system.

Referring now to the figures, FIG. 1 illustrates a schematic view of an example of a compressed air system 100. The compressed air system 100 includes a motor 104 (or a prime mover 104) that is operably connected to a compressor 108. More specifically, the motor 104 is configured to drive the compressor 108 by a drive connection 110. The motor 104 in the illustrated embodiment is a diesel engine. However, in other embodiments the motor 104 can be an electric motor, a natural gas motor, or any other motor (or engine) suitable to drive the compressor 108. The compressor 108 is an oil flooded rotary screw compressor configured to compress a gas, such as air. In other embodiments, the compressor 108 can be any suitable compressor for compressing a gas, such as an oil-flooded reciprocating compressor. In yet other embodiments, the compressor 108 can be an oil free type compressor, such as an oil free rotary screw compressor that uses a lubricant to cool and lubricate the compressor. Accordingly, the term compressor 108 can include any type of oil-free or oil-injected rotary, reciprocating, centrifugal pump, or other device for raising the pressure of a gas, including air. The drive connection 110 can be a direct connection, a drive shaft, or any other suitable connection to operably connect the motor 104 to the compressor 108.

The compressor 108 includes an air supply 112, a lubricant supply 116, and a compression chamber (not shown). The air supply 112 introduces a gas, illustrated as air, to the compressor 108 at a low pressure for compression. The lubricant supply 116 introduces a lubricant, illustrated as oil, to the compressor 108 to cool and lubricate the compressor 108. The low pressure air enters the compression chamber (not shown), where the air is compressed and then discharged as a compressed fluid. The compressed fluid, which includes compressed air and oil, travels along a supply line 120 (or supply piping 120 or a regulation loop 120) to a separator tank 124 (or a separator 124).

The separator tank 124 receives the compressed fluid, and then separates residual lubricant from the compressed gas. In the illustrated example, the separator tank 124 separates oil from the compressed air. The separated lubricant is collected in the separator tank 124, and then removed from the separator tank 124 for reuse. In the illustrated embodiment, oil is separated from the compressed air in the separator tank 124. The oil collects in the bottom of the separator tank 124. The oil is removed from the separator tank 124 for reuse. More specifically, the oil is removed by the lubricant supply 116, where it is reintroduced to the compressor 108. It should be appreciated that in other example of embodiments, the lubricant supply 116 can be any suitable pipe to transport lubricant, such as oil. In addition the lubricant supply 116 can include one or more pumps, a lubricant reservoir, and/or other suitable equipment for the removal, storage, and transport of a compressor lubricant (such as oil).

The separated compressed gas (e.g., compressed gas with a portion of the lubricant removed) exits the separator tank 124. In the illustrated embodiment, the separated compressed air exits the separator tank 124 by a compressed air line 128. The compressed air line 128 is fluidly connected to a service valve 132. The service valve 132 selectively distributes the separated compressed air (or compressed air) for an end use.

Figure 2:
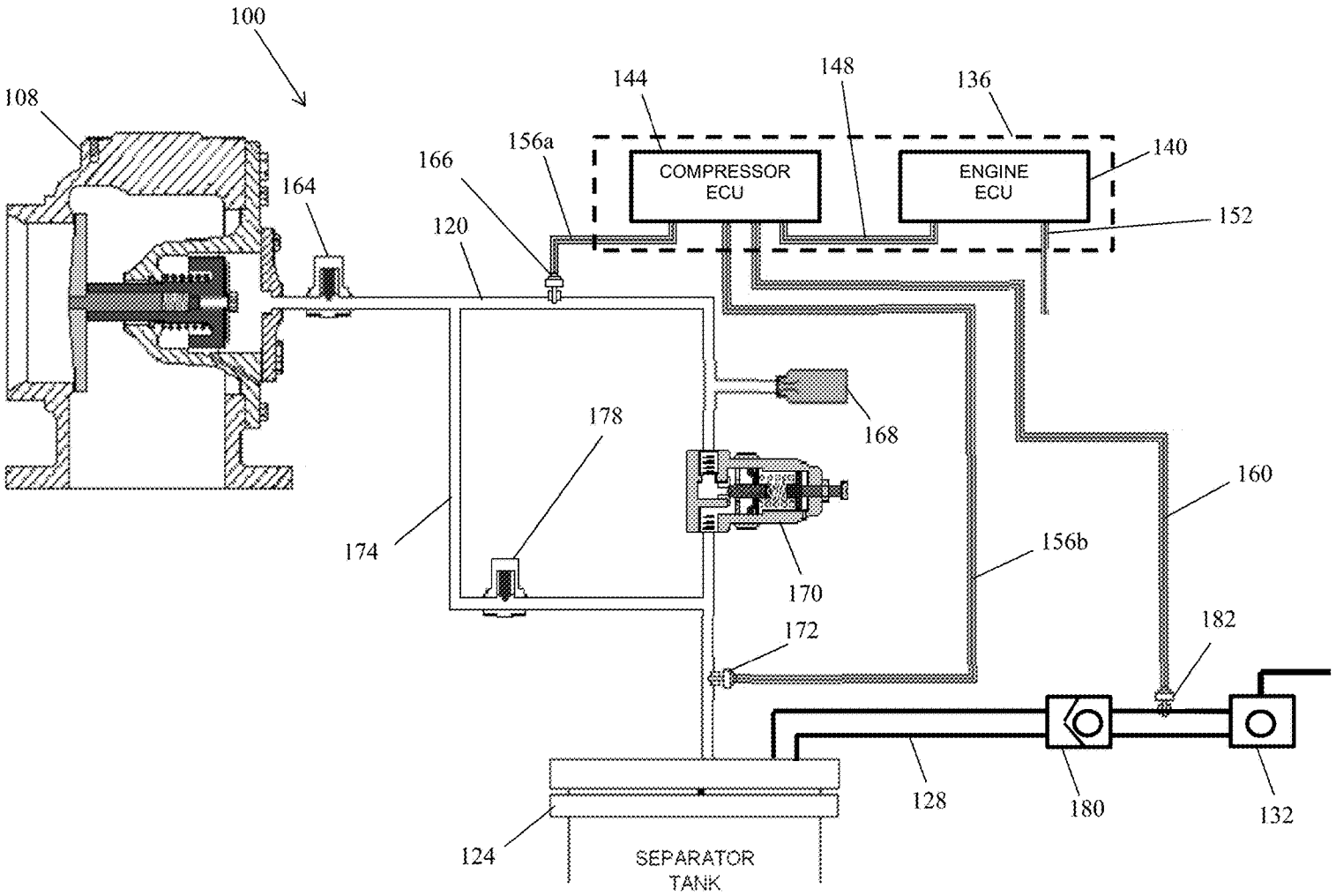
FIG. 2 is a schematic view of a portion of the air compressor of FIG. 1.

A controller 136 is operably connected to a plurality of components of the compressed air system 100. The controller 136 can be an electronic control unit (or "ECU") that is configured to communicate with at least one sensor, to communicate with and control at least one valve, and to communicate with and control at least one component. The controller 136 can also communicate with and control at least one valve and/or at least one component in response to information received from the at least one sensor. As shown in FIG. 2, the controller 136 can include an engine ECU 140 (or motor ECU 140) and a compressor ECU 144. The engine ECU 140 and the compressor ECU 144 are in operable communication with each other by a communication link 148 (or a communication channel 148). While the engine ECU 140 and the compressor ECU 144 are shown as separate control units that are in operable communication, in other embodiments the engine ECU 140 and the compressor ECU 144 can be integrated together as a single control unit. In addition, while the engine ECU 140 and the compressor ECU 144 aspects of the controller 136 are shown as electronic control units, any control system suitable to control one or more aspects of the compressed air system 100 as disclosed herein can be implemented.

With reference back to FIGS. 1 and 2, the controller 136 is in operable communication with the motor 104 by a communication link 152 (or a first communication link 152), is in operable communication with the supply line 120 by a communication link 156 (or a second communication link 156), and is in operable communication with the compressed air line 128 by a communication link 160 (or a third communication link 160).

With reference to FIG. 2, the engine ECU 140 is in communication with the motor 104 by the communication link 152. The controller 136 is configured to detect operation of the motor 104 using the communication link 152. For example, the controller 136 can measure a speed of the motor 104 (e.g., in revolutions per minute (RPM), etc.). To measure the speed, the compressed air system 100 can utilize a speed sensor 154, such as a tachometer or other suitable device to measure motor speed. The speed sensor 154 can be associated with the controller 136, or can be associated with the motor 104. In other embodiments, the controller 136 can measure the rotational speed of the compressor 108 and/or the rotational speed of the drive connection 110 (e.g., the drive shaft 110, etc.). Accordingly, the controller 136 is configured to detect and/or monitor operation of the motor 104. In addition, the controller 136 can operate the motor 104. For example, the engine ECU 140 is in operable communication with the motor 104 by the communication link 152 to allow for control of the speed of the motor 104 (shown in FIG. 2). By adjusting the motor speed, the operation of the compressor 108 can be adjusted (e.g., the compressor 108 speed can be decreased to reduce production of compressed air, the compressor 108 speed can be increased to increase production of compressed air, etc.).

The supply line 120 includes a captive pressure valve 164 (or a first valve 164) that is downstream of the compressor 108. Downstream of the captive pressure valve 164, the supply line 120 includes a first pressure sensor 166 (or a first pressure transducer 166), a pressure relief orifice 168 (or a pressure relief valve 168), a pressure regulator 170, and a second pressure sensor 172 (or a second pressure transducer 172). Downstream of the second pressure sensor 172, the supply line 120 is coupled to the separator tank 124. The supply line 120 also includes a return line 174. The return line 174 is coupled at a first end to the supply line 120 downstream of the pressure regulator 170 and upstream of the separator tank 124, and at a second, opposite end to the supply line 120 downstream of the captive pressure valve 164 and upstream of the first pressure sensor 166. The return line 174 includes a load valve 178 (or a second valve 178). In the illustrated embodiment, the first end of the return line 174 is coupled to the supply line 120 upstream of the second pressure sensor 172. However, in other embodiments the first end of the return line 174 can be coupled to the supply line 120 downstream of the second pressure sensor 172. The captive pressure valve 164 and the load valve 178 are both illustrated as solenoid valves. In other examples of embodiments the valves 164, 178 can be any suitable type of valve (e.g., a motorized ball valve, a motorized gate valve, a motorized valve, etc.).

The controller 136 is in operable communication with the supply line 120 by the communication link 156. More specifically, the controller 136 is in operable communication with the first pressure sensor 166 and the second pressure sensor 172. The first pressure sensor 166 is configured to detect the pressure of compressed air in the supply line 120 downstream of the captive pressure valve 164 and upstream of the pressure relief orifice 168 and the pressure regulator 170. The controller 136 communicates with the first pressure sensor 166 by the communication link **156*a* to receive the detected pressure of compressed air. The second pressure sensor 172 is configured to detect the pressure of compressed air in the supply line 120 downstream of the pressure relief orifice 168 and the pressure regulator 170, and upstream of the separator tank 124. The controller 136 communicates with the second pressure sensor 172 by the communication link 156*b* to receive the detected pressure of compressed air. In the illustrated embodiment, the compressor ECU 144 is in communication with the pressure sensors 166, 172**.

In addition, the controller 136 is in operable communication with the captive pressure valve 164, the pressure relief orifice 168, the pressure regulator 170, and the load valve 178. More specifically, the controller 136 is configured to respectively operate the captive pressure valve 164, the pressure relief orifice 168, the pressure regulator 170, and the load valve 178 by a respective communication link (not shown). The controller 136, illustrated as the compressor ECU 144, is also configured to respectively operate the captive pressure valve 164, the pressure relief orifice 168, the pressure regulator 170, and the load valve 178 in response to a pressure reading detected by at least one of the pressure sensors 166, 172, 182, which is discussed in additional detail below.

With continued reference to FIG. 2, the compressed air line 128 includes a check valve 180 and a third pressure sensor 182. The check valve 180 and the third pressure sensor 182 are each positioned downstream of the separator tank 124 and upstream of the service valve 132. The third pressure sensor 182 is also positioned downstream of the check valve 180. The third pressure sensor 182 is in operable communication with the controller 136, and more specifically the compressor ECU 144, by the communication link 160. The third pressure sensor 182 is configured to detect the pressure of compressed air in the compressed air line 128 downstream of the separator tank 124 and upstream of the service valve 132. The controller 136 communicates with the third pressure sensor 182 by the communication link 160 to receive the detected pressure of compressed air.

FIGS. 3-6 illustrate an example of a control system 200 (or application 200) that is configured to implement the low energy consumption operational configuration (Eco-Mode) in response to detection of idling of the compressed air system 100. More specifically, the control system 200 implements the low energy consumption operational configuration during periods of system nonuse (e.g., a period of non-use of compressed air, etc.). This advantageously reduces fuel consumption during periods of non-use of compressed air, as the motor 104 speed (and in turn the compressor 108 speed and compressed air system 100 pressure) can be reduced due to a reduced demand for compressed air.

The control system 200 also includes an Eco-Mode confirmation. Eco-Mode confirmation includes detection and confirmation of system Eco-Mode for a predetermined period of time. Eco-Mode confirmation can be implemented to avoid implementation of the Eco-Mode based on a false Eco-Mode detection, such as a situation where the system 100 idles for a short period of time between generation of compressed air. Implementation of the Eco-Mode based on the false Eco-Mode detection can lead to undesirable repeated acceleration and deceleration of the motor 104 (and the compressor 108), referred to as "hunting." Hunting can inhibit production of compressed air. In addition, hunting can cause undue stress on the motor 104 and the compressor 108, which can lead to a mechanical failure.

The control system 200 also includes on-demand air generation that initiates a transition from the Eco-Mode to the standard operational configuration. While the compressed air system 100 is in Eco-Mode, the system 100 will transition back (or wake) to standard operation in response to a user command (e.g., a user manually actuates a command, such as a button or a switch, etc.) or in response to compressed air use.

The control system 200 can be a module that is distributed locally on the controller 136, or can be distributed remotely (e.g., operates on a remote server, from a remote location, etc.) and is in communication with the controller 136 (e.g., by any suitable wireless connection, a web portal, a web site, a local area network, generally over the Internet, etc.). The control system 200 includes a series of processing instructions or steps that are depicted in flow diagram form.

Figure 3:
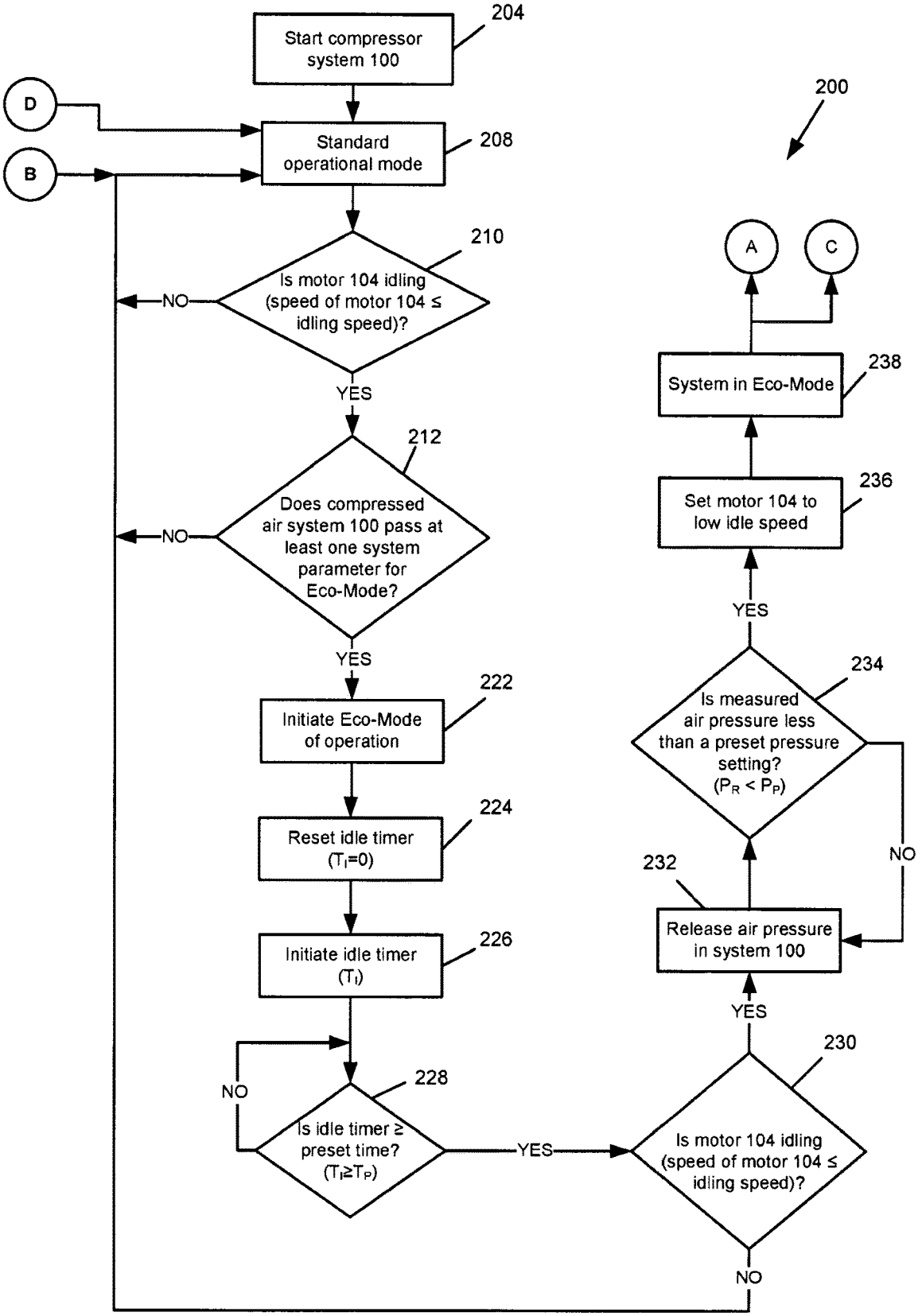
FIG. 3 is a flow diagram of an embodiment of a control system for implementing a low energy consumption operational configuration for the air compressor system in FIG. 1.

Referring to FIG. 3, the process begins at step 204, which starts the compressor system 100. For example, the controller 136 can initiate a load procedure that can include powering on the motor 104 and driving the compressor 108 to produce compressed air. Once the load procedure is complete, the control system 200 moves to step 208, which is the standard operational mode. In the standard operational mode (or a first operational configuration), the compressor system 100 is in a state of "normal" operation. More specifically, and with reference to FIG. 2, the motor 104 drives the compressor 108 to produce compressed air. The compressed air passes through the captive pressure valve 164 and to the separator tank 124 through the supply line 120. The load valve 178 is in a closed configuration, meaning no compressed air flows from the separator tank 124 through the return line 174. Compressed air sent to the separator tank 124 is then separated and stored for use. As a user consumes compressed air through the service valve 132, the controller 136 monitors the compressed air pressure in the compressed air line 128 by the third pressure sensor 182. As the measured pressure decreases, (e.g., as measured by the first pressure sensor 166, etc.) the controller 136 can issue a responsive command to the motor 104 to increase the motor speed in order to make up compressed air from the compressor 108. For example, the compressor ECU 144 can communicate with the engine ECU 140 by the communication link 148 to initiate an increase in the speed of the motor 104. The engine ECU 140 can then communicate with the motor 104 by the communication link 152 (shown in FIGS. 1-2) to increase the motor speed. The speed of the motor remains at an elevated level (or an elevated RPM) to produce additional compressed air and allow the pressure in the compressed air line 128 to plateau and subsequently recover (e.g., the pressure level in the compressed air line 128 increase). Once the pressure level in the compressed air line 128 reaches a predetermined level indicative of a recovered pressure (e.g., as measured by the first pressure sensor 166, etc.), the speed of the motor 104 can be slowed. For example, the compressor ECU 144 can communicate with the engine ECU 140 by the communication link 148 to initiate a decrease in the speed of the motor 104 (i.e., instruct the motor 104 to slow). The engine ECU 140 can then communicate with the motor 104 by the communication link 152 (shown in FIGS. 1-2) to decrease the motor speed. The control system 200 will continue to operate the compressed air system 100 in this manner to regulate to a pressure level in the compressed air line 128 (or at the service valve 132) to supply a sufficient amount of compressed air to the end user.

The demand for compressed air at the service valve 132 will eventually decrease. For example a user will stop using compressed air, which initiates a period of non-use. During this period of demand decrease (or non-use), the compressed air system 100 will continue to produce compressed air until the controller 136 detects a high pressure level at one or more of the pressure sensors 166, 172, 182. For example, the third pressure sensor 182 can detect a pressure of compressed air in the compressed air line 128. The controller 136 can receive the pressure sensor reading from the third pressure sensor 182, and determine whether the pressure exceeds (or is near) a compressed air line high pressure level, which can be a preprogrammed or programmable pressure level representative of a high pressure (e.g., in pounds per square inch gauge or PSIG, etc.). In response to the controller 136 determining that the pressure detected by the third pressure sensor 182 exceeds (or is near) the high pressure level, the controller 136 can instruct the motor 104 to slow.

The first pressure sensor 166 also detects the pressure of compressed air in the regulation loop line 120. The controller 136 can receive the pressure sensor reading from the first pressure sensor 166, and determine whether the pressure exceeds (or is near) a regulation loop line 120 high pressure level, which can be a preprogrammed or programmable pressure level representative of a high pressure (e.g., in PSIG, etc.). In response to the controller 136 determining that the pressure detected by the first pressure sensor 166 exceeds (or is near) the high pressure level, the controller 136 can instruct the motor 104 to slow to an idling speed.

At the idling speed, the motor 104 continues to drive the compressor 108. Stated another way, the compressor 108 continues to generate compressed air at a lower rate. Once at the idling speed, the controller 136 continues to monitor the pressure of compressed air in the separator tank 124 and in the regulation loop 120. In response to the controller 136 determining that the pressure detected by the first pressure sensor 166 exceeds (or is near) the high pressure level and the motor 104 is operating at the idling speed (e.g., as detected by the speed sensor 154, etc.), the regulator 170 will vent excess compressed air from the separator tank 124 to avoid over pressurization of the separator tank 124. This allows compressed air to flow from the separator tank 124 through the regulation loop line 120, where it is vented from the system 100 (e.g., to atmosphere, etc.) out the pressure relief orifice 168. The system 100 will generally remain in this operational idling cycle (i.e., the motor 104 is at idling speed, the compressor 108 supplies compressed air to the separator tank 124 at a lower rate, and air is venting through the relief orifice 168), until an increase in compressed air use (e.g., a user drawing compressed air from the service valve 132, etc.). This increase in compressed air use causes a reduction of air pressure in the regulation loop 120. The controller 136 can receive the pressure sensor reading from the first pressure sensor 166 and determine whether the pressure is below (or is near) a compressed air line low pressure level, which can be a preprogrammed or programmable pressure level representative of a low pressure (e.g., in pounds per square inch gauge or PSIG, etc.). In response to the controller 136 determining that the pressure detected by the first pressure sensor 166 is below (or is near) the low pressure level, the controller 136 can instruct the motor 104 to increase in speed to generate additional compressed air to meet the demand as discussed above, or the control system 200 initiating the low energy consumption operational configuration (or Eco-Mode) as discussed in additional detail below.

While in the standard operational mode, the control system 200 moves to step 210 where it determines whether the motor 104 is idling. More specifically, the controller 136 can determine whether the speed of the motor 104, as detected by the speed sensor 154, is at or below an idling speed (e.g., motor speed <idling speed, etc.). If no, the motor 104 is not idling, the control system 200 returns to step 208 and proceed with the standard operational mode. If yes, the motor 104 is idling, the control system 200 proceeds to step 212.

Figure 4:
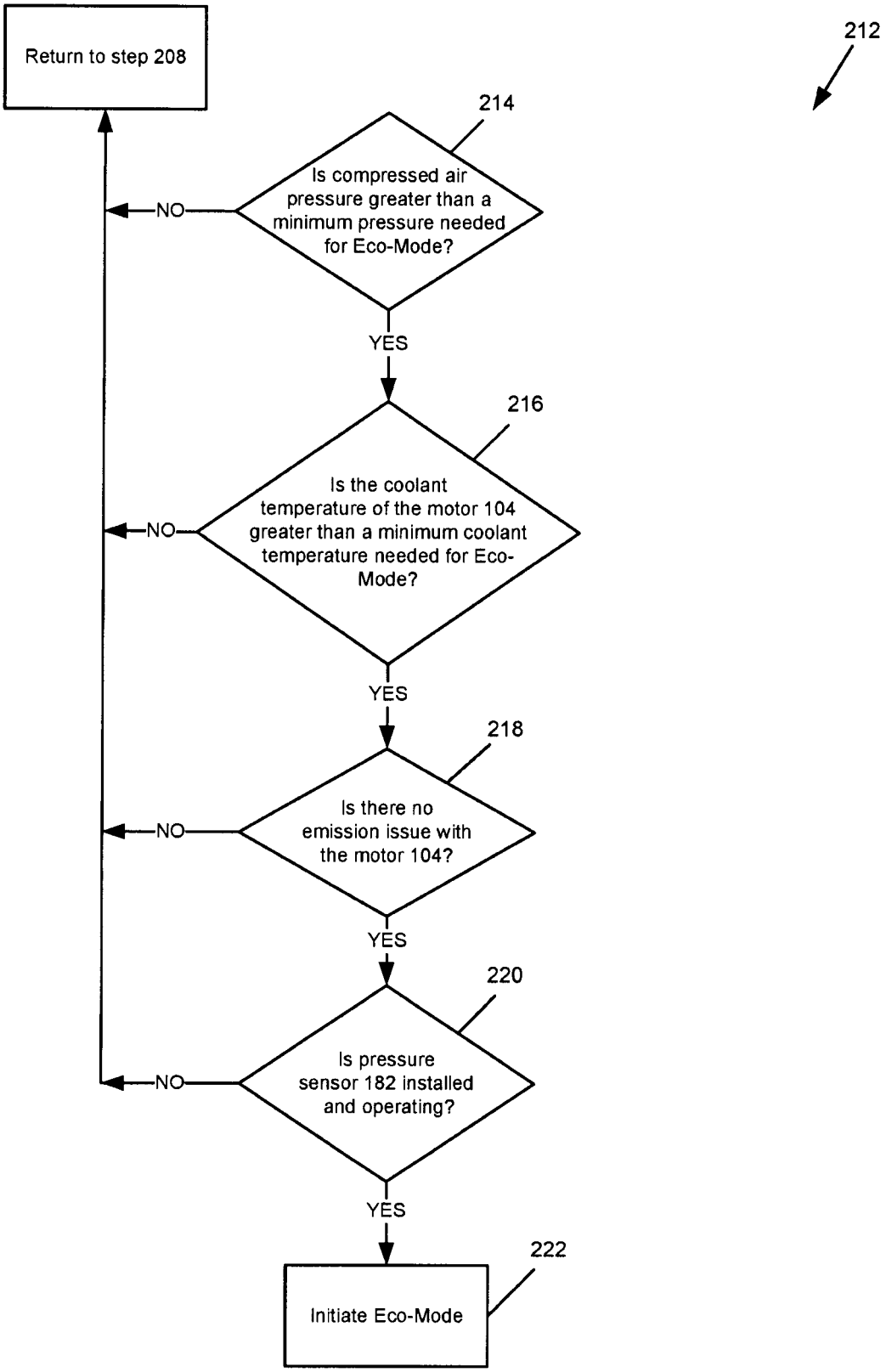
FIG. 4 is a flow diagram of a plurality of system parameters to pass before implementing the low energy consumption operational configuration, one or more of which can be implemented in the control system of FIG. 3.

At step 212, the control system 200 determines whether the compressor system 100 passes at least one system parameter check to proceed to the low energy consumption operational configuration (Eco-Mode). The at least one system parameter check can be provided as a check of certain system components needed to operate in Eco-Mode. With reference now to FIG. 4, step 212 is illustrated in greater detail.

A first example of a system parameter check is at step 214, where the controller 136 determines whether the pressure of compressed air is greater than a minimum pressure of compressed air needed for Eco-Mode. Detection of system 100 pressure is performed by the first pressure sensor 166 in the regulation loop line 120. If no, the measured pressure does not exceed (or is not greater than) the minimum pressure, the process returns to step 208 and continues in standard operational mode. If yes, the measure pressure does exceed (or is greater than) the minimum pressure, the control system 200 can proceed to another system check 216, 218, 220. Alternatively, the control system 200 can proceed from step 212 to step 222 and initiate Eco-Mode (see FIG. 3).

A second example of a system parameter check is at step 216, where the controller 136 determines whether the coolant temperature associated with the motor 104 is greater than a minimum coolant temperature needed for Eco-Mode. For example, the controller 136 can be in communication with a temperature sensor (not shown) by the communication link 152. The temperature sensor (not shown) can be configured to measure the temperature of coolant for the motor 104. The controller 136 can determine whether the temperature of the coolant for the motor 104 exceeds a minimum coolant temperature for the motor 104 to operate in Eco-Mode (e.g., is the measured coolant temperature >approximately 122° F. (or approximately 50° C.), etc.). If no, the measured temperature of coolant for the motor 104 does not exceed (or is not greater than) the minimum coolant temperature, the process returns to step 208 and continues in standard operational mode. If yes, the measured temperature of coolant for the motor 104 does exceed (or is greater than) the minimum coolant temperature, the control system 200 can proceed to another system check 218, 220. Alternatively, the control system 200 can proceed from step 212 to step 222 and initiate Eco-Mode (see FIG. 3).

A third example of a system parameter check is at step 218, where the controller 136 determines whether there are any emission issues with the motor 104. For example, the controller 136 can be in communication with an emission sensor (not shown) by the communication link 152. The emission sensor can be configured to measure certain emissions (e.g., SOx, NOx, etc.) emitted in the exhaust of the motor 104. The controller 136 can analyze the detected emissions from the emission sensor (not shown) and determine whether the detected emissions exceed an associated emission level sufficient to trigger an emission issue. If no, there is no emission issue with the motor 104 (or stated otherwise, there is an emission issue with the motor 104), the process returns to step 208 and continues in standard operational mode. If yes, the there is no emission issue with the motor 104, the control system 200 can proceed to another system check 220. Alternatively, the control system 200 can proceed from step 212 to step 222 and initiate Eco-Mode (see FIG. 3).

A fourth example of a system parameter check is at step 220, where the controller 136 determines the pressure sensor 182 is installed and properly operating. For example, the controller 136 can perform a diagnostic on the pressure sensor 182 to determine whether the sensor 182 is installed and operating properly. If no, pressure sensor 182 is not installed or not operating properly, the process returns to step 208 and continues in standard operational mode. If yes, the pressure sensor 182 is installed and/or is operating properly, the control system 200 can proceed to system check, 218. Alternatively, the control system 200 can proceed from step 212 to step 222 and initiate Eco-Mode (see FIG. 4).

While FIG. 4 illustrates a plurality of system parameter checks to pass before implementing the low energy consumption operational configuration (Eco-Mode), it should be appreciated that in other embodiments the control system 200 can implement only one of the system parameter checks identified in steps 214-220. In yet other embodiments, the control system 200 can implement a plurality of the system parameter checks identified in steps 214-220, including any combination up to and including all of the system parameter checks. In addition, the system parameter checks identified in steps 214-220 can be performed concurrently or in any suitable or desired order.

Referring back to FIG. 3, once all of the system parameter checks at step 212 are completed and passed, the control system 200 proceeds to step 222 and initiates the low energy consumption operational configuration (or the second operation configuration or mode (Eco-Mode)). Next at steps 224 to 230, the control system 200 determines whether the motor 104 is idling for a predetermined, sustained period of time before initiating a compressed air pressure unloading sequence. This is to avoid reducing the compressed air pressure in system 100 during implementation of Eco-Mode in response to a short window of motor 104 idling. At step 224, the control system 200 resets an idle timer $T_i$ (e.g., $T_i$=0; , etc.). Next, at step 226 the control system 200 initiates the idle timer $T_i$. In the illustrated embodiment, the idle timer $T_i$ is a count-up timer. However, in other embodiments, the idle timer $T_i$ can be a count-down timer (with the system resetting the timer to a predetermined time value).

Next, at step 228, the control system 200 determines whether the idle timer $T_i$ equals or exceeds a preset time $T_P$. Stated another way, step 228 determines if an amount of time has elapsed. In the illustrated embodiment, the preset time $T_p$ is approximately three (3) seconds. However, in other embodiments, the preset time $T_p$ can be any suitable or desired amount of time. If no, the necessary (or desired) amount of time has not elapsed, the control system 200 repeats step 228. If yes, the necessary (or desired) amount of time has elapsed (e.g., $T_i \geq T_p$), the control system 200 proceeds to step 230.

At step 230, the control system 200 determines whether the motor 104 is idling. Stated another way, the control system 200 determines whether the motor 104 is continuing to idle after the amount of time has elapsed. The controller 136 can determine whether the speed of the motor 104, as detected by the speed sensor 154, is at or below an idling speed (e.g., motor speed ≤idling speed, etc.). If no, the motor 104 is not idling, the control system 200 returns to step 208 and proceeds with the standard operational mode. If yes, the motor 104 is idling, the control system 200 proceeds to step 232. It should be appreciated that steps 224 to 230 are performed by the controller 136.

At step 232, the system initiates a reduction in the compressed air system 100 pressure by releasing compressed air. More specifically, the controller 136 opens the load valve 178 to an open configuration. This allows compressed air to flow from the separator tank 124 through the return line 174, where it is vented from the compressed air system 100 (e.g., to atmosphere, etc.) out the pressure relief orifice 168. At step 234, the system determines whether the air pressure in the compressed air system 100 is less than (or less than or equal to) a preset pressure setting (or a low idle pressure). For example, the controller 136 receives a pressure reading $P_R$ from the second pressure sensor 172 (and/or the first pressure sensor 166). The controller 136 then determines whether the pressure reading $P_R$ is less than a preset pressure setting $P_P$ (e.g., $P_R<P_p$). In the illustrated embodiment, the preset pressure setting $P_P$ is approximately 90 PSIG. However, in other embodiments, the preset pressure setting $P_P$ can be any suitable preprogrammed or user programmed pressure setting. If no, the pressure reading $P_R$ from the second pressure sensor 172 (and/or the first pressure sensor 166) is not less than the preset pressure setting $P_P$, the process returns to step 232 and continues to vent compressed air from the compressed air system 100, further lowering the pressure in the compressed air system 100. If yes, the pressure reading $P_R$ from the second pressure sensor 172 (and/or the first pressure sensor 166) is less than the preset pressure setting $P_P$, the process proceeds to step 236. It should be appreciated that the preset low idle pressure setting $P_P$ is lower than the system pressure when the motor is idling (or operates at an idle speed).

At step 236, the control system 200 sets the motor 104 to a low idle speed. To reduce the motor speed to the low idle speed, the controller 136 instructs the motor 104 to operate at a speed that is slower than the idle speed. For example, in some compressed air systems, the idle speed can be between approximately 1350 rpm to 1500 rpm. The low idle speed can be between approximately 800 rpm to 1200 rpm, and in other embodiments can be less than 1200 rpm, and in yet other embodiments can be approximately 800 rpm. Generally, the low idle speed is slower than the idle speed, and the idle speed is slower than the speed of the motor 104 during the standard operational mode (or normal operation). Once the pressure in the compressed air system 100 is below the preset pressure setting (e.g., below 90 PSIG, etc.) and the motor 104 is operating at the low idle speed (e.g., approximately 800 rpm, etc.), the compressed air system 100 is at step 238 and has entered Eco-Mode.

Figure 5:
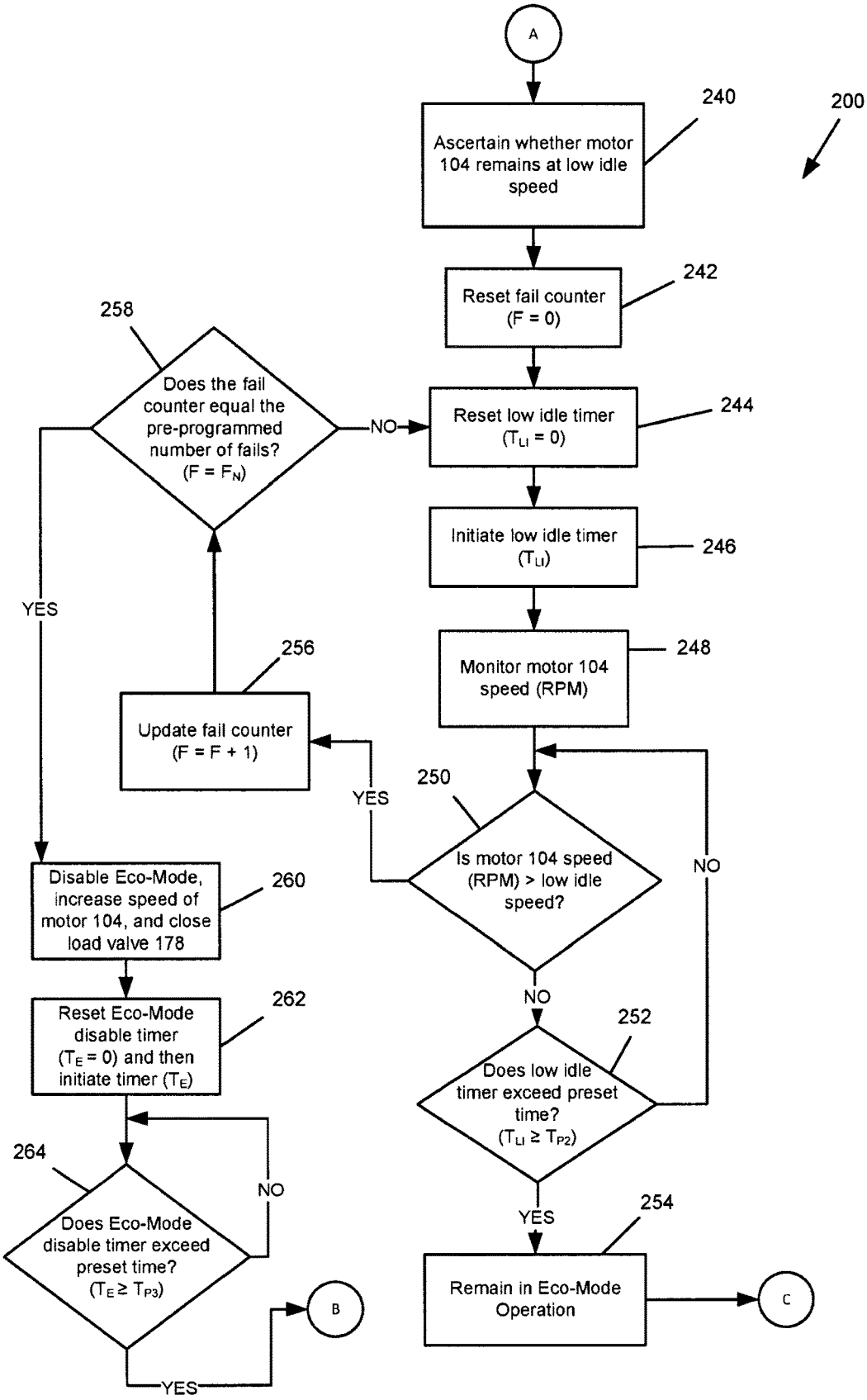
FIG. 5 is a flow diagram of idling confirmation that can be implemented in the control system of FIG. 3.

With reference now to FIG. 5, the compressed air system 100 has entered Eco-Mode. The control system 200 can also include Eco-Mode confirmation, which is illustrated in FIG. 5. Eco-Mode confirmation can be initiated upon implementation of Eco-Mode. More specifically, at step 240 the control system 200 attempts to ascertain whether the motor 104 is remaining at the low idle speed, or attempting to speed up (to either idling speed or the speed at standard operational mode). At step 242 a fail counter F is reset (e.g., F=0). The fail counter is configured to count the number of times the control system 200 detects that the motor 104 is not remaining at the low idle speed for a period of time (e.g., the motor 104 is accelerating and/or decelerating, or hunting, etc.).

At step 244, the control system 200 resets a low idle timer $T_{LI}$ (e.g., $T_{LI}$=0, etc.). Next, at step 246 the control system 200 initiates the low idle timer $T_{LI}$. In the illustrated embodiment, the low idle timer $T_{LI}$ is a count-up timer. However, in other embodiments, the low idle timer $T_{LI}$ can be a count-down timer (with the system resetting the timer to a predetermined time value).

Next, at step 248 the control system 200 monitors the speed of the motor 104. More specifically, the controller 136 is in communication with the speed sensor 154 (shown in FIG. 1) to detect the speed of the motor 104. At step 250, the control system 200 determines whether the speed of the motor 104 is exceeding the low idle speed, or whether the speed of the motor 104 is remaining at (or near) the low idle speed. More specifically, the controller 136 can determine whether the speed of the motor 104, as detected by the speed sensor 154, is above (or greater than) the low idling speed (e.g., motor speed>low idle speed, etc.). If no, the motor 104 is operating at a speed that is not in excess of the low idle speed (e.g., the motor 104 is not operating faster than 1200 rpm, or the motor is operating slower than the idling speed, etc.) the control system 200 proceeds to step 252.

At step 252, the control system 200 determines whether the low idle timer $T_{LI}$ equals or exceeds a preset time $T_{P2}$. Stated another way, step 252 determines if an amount of time has elapsed. In the illustrated embodiment, the preset time $T_{P2}$ is approximately twenty (20) seconds. However, in other embodiments, the preset time $T_{P2}$ can be any suitable or desired amount of time. If no, the necessary (or desired) amount of time has not elapsed, the control system 200 returns to step 250 to continue to monitor the speed of the motor 104. If yes, the necessary (or desired) amount of time has elapsed (e.g., $T_{LI} \geq T_{P2}$), and the speed of the motor 104 remains at (or does not exceed) the low idling speed during the elapsed time period, the control system 200 proceeds to step 254.

At step 254, the control system 200 determines the motor 104 is not cycling up and down in speed (e.g., accelerating and decelerating, or hunting) as the motor 104 has remained at (or near) the low idle speed for the predetermined amount (or period) of time. As such, the control system 200 determines there is no false idling. The control system 200 then remains in Eco-Mode (or the low energy consumption operational configuration).

Returning back to step 250, if the control system 200 detects that yes, the motor 104 is operating at a speed that is in excess of the low idle speed (e.g., the motor 104 is operating faster than 1200 rpm, or the motor is operating at or above the idling speed, etc.) during the elapsed time period, the control system 200 initiates a fail procedure and proceeds to step 256.

At step 256, the control system 200 incrementally increases the fail counter, indicating that a fail was detected (a fail being the motor 104 operating faster than the low idle speed during the elapsed time period). In the illustrated embodiment, the fail counter F is increased by one (1), or F=F+1. In other embodiments, any counter can be implemented that is suitable to track a number of fail detections.

Next, at step 258 the control system 200 determines whether the updated fail counter F equals a pre-programmed number of fails FN (e.g., $F \geq F_N$, etc.). In the illustrated embodiment, the pre-programmed number of fails $F_N$ is three (3). However, in other embodiments the pre-programmed number of fails FN can be any suitable number (1, 2, 4 or more, etc.). If no, the updated fail counter F is less than (or not equal to) the pre-programmed number of fails $F_N$ (e.g., $F<F_N$), the process returns to step 244, and steps 244 through 252 repeat. If yes, the updated fail counter does equal (or is not less than) the pre-programmed number of fails $F_N$ (e.g., $F=F_N$, $F \geq F_N$, etc.), the process proceeds to step 260.

Entering step 260, the control system 200 has determined that the motor 104 is cycling up and down in speed (e.g., accelerating and decelerating, or hunting). This is due to the motor 104 exceeding the low idle speed during the predetermined elapsed time period a number of separate occasions (e.g., at least the pre-programmed number of fails $F_N$, or at least three separate times in the illustrated embodiment). At step 260, the control system 200 disables the Eco-Mode, increases the speed of the motor 104, and closes the load valve 178. For example, the controller 136 can issue a command to the motor 104 to increase the motor speed back to the idling speed (or a speed that is greater than the low idling speed, including the speed at standard operational mode). It should be appreciated that the control system 200 can return the compressed air system 100 to the standard operational mode.

Next at step 262, the control system 200 resets an Eco-Mode disable timer $T_E$ (e.g., TE=0, etc.) and then initiates the Eco-Mode disable timer $T_E$. In the illustrated embodiment, the Eco-Mode disable timer $T_E$ is a count-up timer. However, in other embodiments, the Eco-Mode disable timer $T_E$ can be a count-down timer (with the system resetting the timer to a predetermined time value).

Next, at step 264 the control system 200 determines whether the Eco-Mode disable timer $T_E$ exceeds (or equals) a preset time $T_{P3}$. Stated another way, step 264 determines if an amount of time has elapsed during which Eco-Mode is suspended. In the illustrated embodiment, the preset time $T_{P3}$ is approximately five (5) minutes. However, in other embodiments, the preset time $T_{P3}$ can be any suitable or desired amount of time. If no, the necessary (or desired) amount of time has not elapsed during which Eco-Mode is suspended, the control system 200 repeats step 264. If yes, the necessary (or desired) amount of time has elapsed during which Eco-Mode is suspended (e.g., $T_E \geq T_{P3}$), the control system 200 proceeds to step 208 and returns to the standard operational mode of system control (see FIG. 3). Once returned to step 208, the system steps recited above are free to repeat. It should also be appreciated that steps 240-264 are performed by the controller 136.

Figure 6:
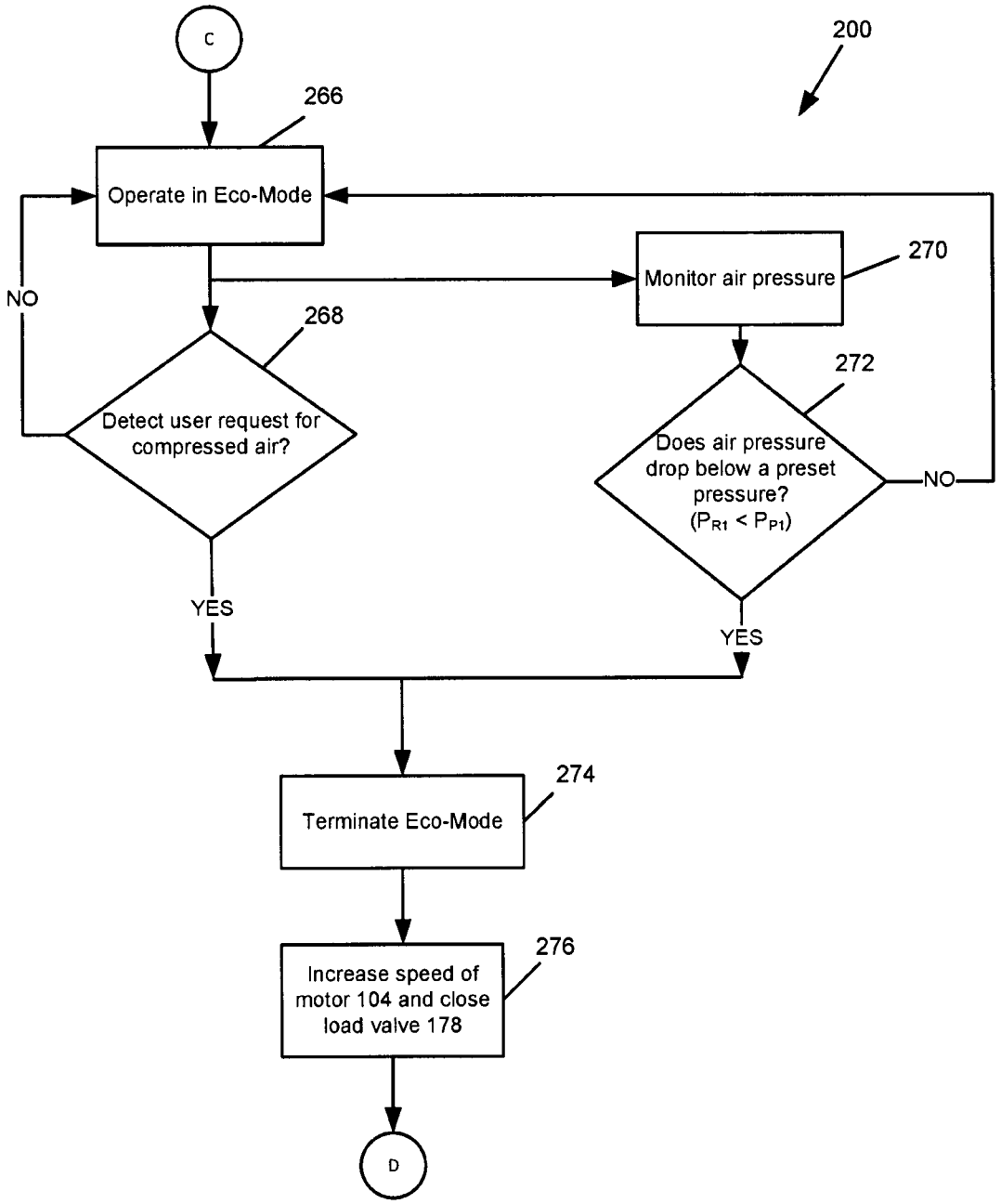
FIG. 6 is a flow diagram of on-demand air generation that initiates a transition from the low energy consumption operational configuration to the standard operational configuration in response to compressed air use or a user entered command.

Referring now to FIG. 6, the control system 200 can include an on-demand air generation that initiates a transition from the Eco-Mode to the standard operational configuration. At step 266 the compressed air system 100 is operating in Eco-Mode, with the motor 104 operating at the low idle speed, and the pressure in the compressed air system 100 being below the preset pressure setting.

At step 268, while in the Eco-Mode, the control system 200 can detect whether there is a user request for compressed air. For example, the compressed air system 100 can include a switch, button, or other actuator (not shown), which is in communication with the controller 136 and allows a user to request compressed air on demand. If the control system 200, and specifically the controller 136, does not detect a user request for compressed air (e.g., there is no signal from the switch, button, or other actuator), or "no" at step 268, the control system 200 returns to step 266 and remains in Eco-Mode operation. If the control system 200, and specifically the controller 136, does detect a user request for compressed air (e.g., there is a signal from the switch, button, or other actuator), or "yes" at step 268, the control system 200 proceeds to step 274, which is discussed in additional detail below.

The control system 200 can also monitor the pressure of compressed air in the air compressor system 100 at step 270. For example, the controller 136 can receive a pressure reading $P_{R2}$ from the third pressure sensor 182. Next, at step 272 the controller 136 determines whether the pressure reading $P_{R1}$ is less than a preset pressure setting $P_{P1}$ (e.g., $P_{R1}<P_{P1}$). In the illustrated embodiment, the preset pressure setting $P_{P1}$ (or pressure set point $P_{P1}$) can be a preprogrammed or user programmed pressure setting. Generally, the lower the preset pressure setting $P_{P1}$, the greater the fuel savings but the longer the reload time of the compressed air system 100 (or reaction time to return to an increased load of compressed air). The preset pressure setting $P_{P1}$ can also be a percentage setting (e.g., 30%, etc.) that can be multiplied by a custom pressure setting with the percentage setting being adjustable by the user (and/or the custom pressure setting being adjustable by the user). As a non-limiting example, with a hypothetical custom pressure setting of 75 PSIG, the user can select a 30% percentage setting such that the preset pressure setting $P_{P1}$ can be 52.5 PSIG.

If no, the controller 136 determines that the detected pressure reading $P_{R1}$ is not less than the preset pressure setting $P_{P1}$ (or stated otherwise the detected pressure reading $P_{R1}$ is greater than the preset pressure setting $P_{P1}$), the control system 200 returns to step 266 and remains in Eco-Mode operation. If yes, the controller 136 determines that the detected pressure reading PR1 is less than the preset pressure setting PP1, the control system proceeds to step 274. It should be appreciated that compressed air pressure monitoring at steps 270, 272 can be performed concurrently with the detection of (or listening for) a customer request for compressed air at step 268.

At step 274, the control system 200 terminates Eco-Mode in response to the user request for compressed air (see step 268) or demand for compressed air due to a reduction in system pressure (generally caused by compressed air use) (see steps 270-272). At step 276, the control system 200 increases the speed of the motor 104 and closes the load valve 178. For example, the speed of the motor 104 can be increased to the speed during the standard operational mode (or normal operation). The increase in motor speed increases the air pressure in the system 100 to the standard operational mode (or normal operation). In other embodiments, the speed of the motor 104 can be increased to its maximum speed (or a speed greater than the speed in the standard operational mode) in order to generate compressed air. The control system 200 then returns to step 208 (shown in FIG. 3), which is the standard operational mode. In the standard operational mode (or a first operational configuration), the compressor system 100 is in a state of "normal" operation.

The control system 200 advantageously reduces energy (or fuel) consumption during periods of motor idling or compressed air system 100 non-use. In addition, the control system 200 can include an idling confirmation to avoid a false Eco-Mode detection, which can lead to undesirable repeated acceleration and deceleration of the motor 104 (referred to as motor hunting). The control system 200 can also include on-demand air generation, where the control system 200 transitions from the low energy consumption operational configuration (or Eco-Mode) to the standard operational configuration (or normal operational mode) in response to detection of a reduction in compressed air pressure in the compressed air system 100 or in response to detection of a customer initiated request for compressed air.

Various additional features and advantages of the disclosure are set forth herein.

What is claimed is:

1. An air compressor system comprising:

a motor operably connected to an air compressor;

a separator tank fluidly connected to the air compressor by a supply line;

a compressed air line coupled to the separator tank;

a service valve connected to the compressed air line and positioned downstream of the separator tank;

a controller in operable communication with the motor, wherein in response to the controller detecting the motor operating at an idle speed, the controller reduces the motor speed to a low idle speed, the low idle speed being slower than the idle speed;

a pressure relief orifice positioned in the supply line downstream of the air compressor and upstream of the separator tank; and a return line coupled to the supply line, the return line including a valve, a first end of the return line coupled to the supply line downstream of the air compressor and upstream of the pressure relief orifice, and a second end of the return line coupled to the supply line downstream of the pressure relief orifice and upstream of the separator tank, wherein in response to reducing the motor speed to the low idle speed, the controller reduces the pressure of compressed air in the separator tank, and wherein the controller reduces the pressure of compressed air in the separator tank by opening the valve to vent compressed air through the return line and out the pressure relief orifice.

2. The air compressor system of claim 1, further comprising an actuator in operable communication with the controller, wherein in response to actuation of the actuator by a user the controller increases the motor speed above the low idle speed.

3. The air compressor system of claim 2, wherein the controller increases the motor speed to a speed that exceeds the idle speed.

4. The air compressor system of claim 2, wherein the actuator is a user actuated switch.

5. The air compressor system of claim 1, wherein in response to the controller detecting the motor operating at an idle speed, the controller monitors the speed of the motor for a predetermined period of time.

6. The air compressor system of claim 5, wherein in response to the controller detecting the motor operating at an idle speed after the predetermined period of time, the controller reduces the motor speed to the low idle speed.

7. The air compressor system of claim 5, wherein in response to the controller detecting the motor operating at a speed in excess of the idle speed during the predetermined period of time, the controller resets the predetermined period of time and then monitors the speed of the motor for the predetermined period of time.

8. The air compressor system of claim 7, wherein in response to the controller detecting the motor operating at a speed in excess of the idle speed during the predetermined period of time, the controller updates a fail counter.

9. The air compressor system of claim 8, wherein in response to the controller detecting the motor operating at a speed in excess of the idle speed during the predetermined period of time, the controller determines whether the fail counter meets a predetermined number of fails.

10. The air compressor system of claim 9, wherein in response to the controller determining the fail counter meets the predetermined number of fails, the controller initiates an idle run timer during which the motor operates at the idle speed.

11. The air compressor system of claim 10, wherein the idle run timer is at least five minutes.

12. The air compressor system of claim 1, wherein in response to reducing the motor speed to the low idle speed, the controller reduces the pressure of compressed air in the separator tank to a low idle pressure setting.

13. The air compressor system of claim 12, further comprising a pressure sensor downstream of the air compressor and upstream of the separator tank, the pressure sensor in communication with the controller and operable to detect a pressure of compressed air in the separator tank.

14. The air compressor system of claim 13, wherein in response to the pressure sensor detecting a pressure below a preset pressure setting less than the low idle pressure setting, the controller increases the motor speed above the low idle speed.

15. The air compressor system of claim 14, wherein the controller increases the motor speed to a speed that exceeds the idle speed.

16. The air compressor system of claim 14, wherein the preset pressure setting is a user adjustable set point.

17. The air compressor system of claim 12, wherein the low idle pressure setting is less than a pressure setting when the motor is operating at the idle speed.

* * * * *